US005975351A

United States Patent [19]

DeLacerda

[11] Patent Number: 5,975,351

[45] Date of Patent: Nov. 2, 1999

[54] METHOD AND SYSTEM FOR STABILIZING BULK BAGS DURING EMPTYING

[75] Inventor: Lisa DeLacerda, Lafayette, La.

[73] Assignee: FlexCon & Systems, Inc., Lafayette, La.

[21] Appl. No.: 08/824,447

[22] Filed: Mar. 26, 1997

[51] Int. Cl.[6] ..... G01F 11/00

[52] U.S. Cl. ..... 222/1; 22/105; 22/160; 22/181.2; 22/377; 22/382; 22/464.7

[58] Field of Search ..... 222/1, 105, 160, 222/180, 181.2, 377, 382, 464.1, 464.7

[56] References Cited

U.S. PATENT DOCUMENTS

| | | | |
|---|---|---|---|
| 4,113,146 | 9/1978 | Williamson | 222/105 |
| 4,143,796 | 3/1979 | Williamson et al. | 222/181.2 |
| 4,194,652 | 3/1980 | Williamson | 222/185 |
| 4,527,716 | 7/1985 | Haas et al. | 222/835 |
| 4,688,979 | 8/1987 | Kupersmit | 222/181.2 |
| 4,966,311 | 10/1990 | Taylor | 222/105 |
| 5,069,596 | 12/1991 | Mueller et al. | 414/607 |
| 5,257,725 | 11/1993 | Volk, Jr. et al. | 222/185 |
| 5,320,251 | 6/1994 | Ellis | 222/181.2 |
| 5,333,757 | 8/1994 | Volk et al. | 222/181.2 |
| 5,354,166 | 10/1994 | De Crane | 414/561 |
| 5,382,117 | 1/1995 | Rings et al. | 222/180 |
| 5,415,323 | 5/1995 | Fenelon | 222/181.2 |

*Primary Examiner*—Joseph A. Kaufman
*Attorney, Agent, or Firm*—Garvey, Smith, Nehrbass & Doody

[57] ABSTRACT

A method for siphoning product from a bulk bag while maintaining the bag upright at all times during siphoning which includes the steps of providing a bulk bag containing the dry bulk product; providing a support frame for supporting the bag upright through the lifting loops of the bulk bag; siphoning the product from the bulk bag through a vacuum line inserted in the bulk within the bag; and providing a pressurized cylinder attached to the frame which supports the bag upright through the lifting loops for imparting sufficient force upward on the lifting loops of the bulk bag so as to support the bag upright and lift the bag as the product is siphoned from the bag, yet while allowing the product remaining in the bag to move to a central portion of the bag, so that the siphoning nozzle makes contact with the product within the bag at all times during siphoning.

16 Claims, 6 Drawing Sheets

METHOD AND SYSTEM FOR STABILIZING BULK BAGS DURING EMPTYING

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fabric bulk bags. More particularly, the present invention relates to a method and a system for enabling a fabric bulk bag to be emptied of bulk material through vacuuming of the bulk material from the bag while maintaining the bag in an upright position during the method, and by assuring that the bulk within the bag is contained substantially within the central location of the bag at all times during emptying of the bag.

2. General Background of the Invention

Bulk bags are for the most part bags constructed of a polypropylene material which would normally be of the type having four side walls, a bottom wall, a top wall and means such as loops for lifting the bag with a forklift after the bag has been loaded with bulk. Often times the bulk bag of this type includes an internal polyethylene liner which may or may not be secured to the bag via gluing or the like, so that certain types of dry bulk material which may be contained within the bag are, for the most part, free from contamination within the polyethylene liner.

One type of bulk bag which is utilized for transporting dry bulk material and may or may not include a polyethylene liner, would not necessarily include a down spout or discharge spout for allowing the dry bulk material to flow from the bag. Certain types of bags have no discharge spout, but simply are constructed so that the dry bulk material within the bag can be vacuumed or siphoned out of the bag with a nozzle being inserted through the polyethylene liner at the top of the bag, and the nozzle siphoning the dry bulk material out of the bag as the bag is resting on a platform or the like. One drawback to this particular method, in the present state of the art, is that, because of the nature of a siphoning system, the siphon would tend to siphon the bulk material which is directly surrounding the siphoning nozzle within the bag. For example, if the nozzle happens to be in an area of the bag adjacent to one of the side walls, then the bulk material which would be siphoned from the bag would naturally be that material next to the side wall, unless the nozzle is periodically moved throughout the bag. What may occur in this situation is the fact that once bulk material is siphoned from one wall of the bag, the bulk material on the opposite wall may cause the bag to become unbalanced and to literally fall over due to the unequal distribution of the bulk material within the bag. This, of course, is undesirable since if the bag would tilt over, the bulk material within the bag may spill out through the hole in the polyethylene liner and become contaminated or the nozzle may punch a hole in the polyethylene liner within the bag which would then cause a contamination of perhaps all of the bulk material within the bag. Therefore, there is a need in the art for a method and a system for assuring that as the bulk is emptied, through vacuuming from the top of the bag, the bag is maintained upright at the same time that the nozzle is within the bulk material at all times so as to allow flow of bulk from the bag in a quick and efficient manner.

Applicant is submitting herewith the prior art statement regarding patents which have been reviewed which may be pertinent to the subject matter of this invention.

BRIEF SUMMARY OF THE INVENTION

The method and system of the present invention solves the problem of the art in a simple and straightforward manner. The method for siphoning product from a bulk bag while maintaining the bag upright at all times during siphoning would include the steps of providing a bulk bag containing the dry bulk product; providing a support frame for supporting the bag upright through the lifting loops of the bulk bag; siphoning the product from the bulk bag through a vacuum line inserted in the bulk within the bag; and providing a pressurized cylinder attached to the frame which supports the bag upright through the lifting loops for imparting sufficient force upward on the lifting loops of the bulk bag so as to continue to hold the bag upright as the product is siphoned from the bag, yet while allowing the product remaining in the bag to move to a central portion of the bag, so that the siphoning nozzle makes contact with the product within the bag at all times during siphoning.

The system which undertakes the method of the present invention includes a frame having a first base portion and a vertical post portion extending upward from the base, and including an arm for engaging the lifting loops of the bulk bag, while the bulk bag is resting on the base portion of the frame; the vertical post portion is extendable from a first down position to a second up position, by the use of a pressurized cylinder which may be pneumatic or hydraulic, for imparting sufficient upward force on the lifting loops to hold the bag upright at all times during the siphoning process so that as product is siphoned out of the bag, the lifting loops are continually pulled in the upward direction via the force imparted by the pressurized cylinder, until such time as the force of the cylinder overcomes the weight of the bag which results in the vertical post being extended to its most up position with the bulk bag hanging by the lifting loops and whatever product remains in the bag being siphoned from the central most bottom point of the bag until the bag is emptied.

Therefore, it is a principal object of the present invention to provide a method for siphoning product from a bulk bag which allows a bulk bag to be maintained upright during the siphoning process, while the product is maintained in the central portion of the bag in contact with the siphoning nozzle;

It is a further principal object of the present invention to provide a system for emptying a filled bulk bag, by engaging the bulk bag by the lifting loops and imparting sufficient upward force on the bulk bag so that as the bulk bag is emptied, the bag serves as its own counterweight, and the lifting loops are continually pulled upward to maintain the bag in a substantially vertical position, while the bulk within the bag will be continued to be maintained within the central part of the bag during siphoning;

It is a further object of the present invention to provide a method for siphoning bulk from the top portion of a filled bulk bag, which prevents product within the bag from being siphoned from one part of the bag which would result in the bag becoming unbalanced and having a tendency to fall over during the siphoning process;

It is a further object of the present invention to provide a system for allowing a bulk bag filled with dry bulk product to be supported on a frame by the lifting loops of the bag, so that as product is siphoned from the top of the bag, the bag will serve as its own counterweight, maintained upright, and the product will move to the central portion of the bag, in contact with the centrally positioned nozzle, until the bulk within the bag has been sufficiently siphoned so that the upward force on the bag overcomes the weight of the bag and the result is the bag, when emptied, hanging from the frame completely empty of product.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

Figure 6:
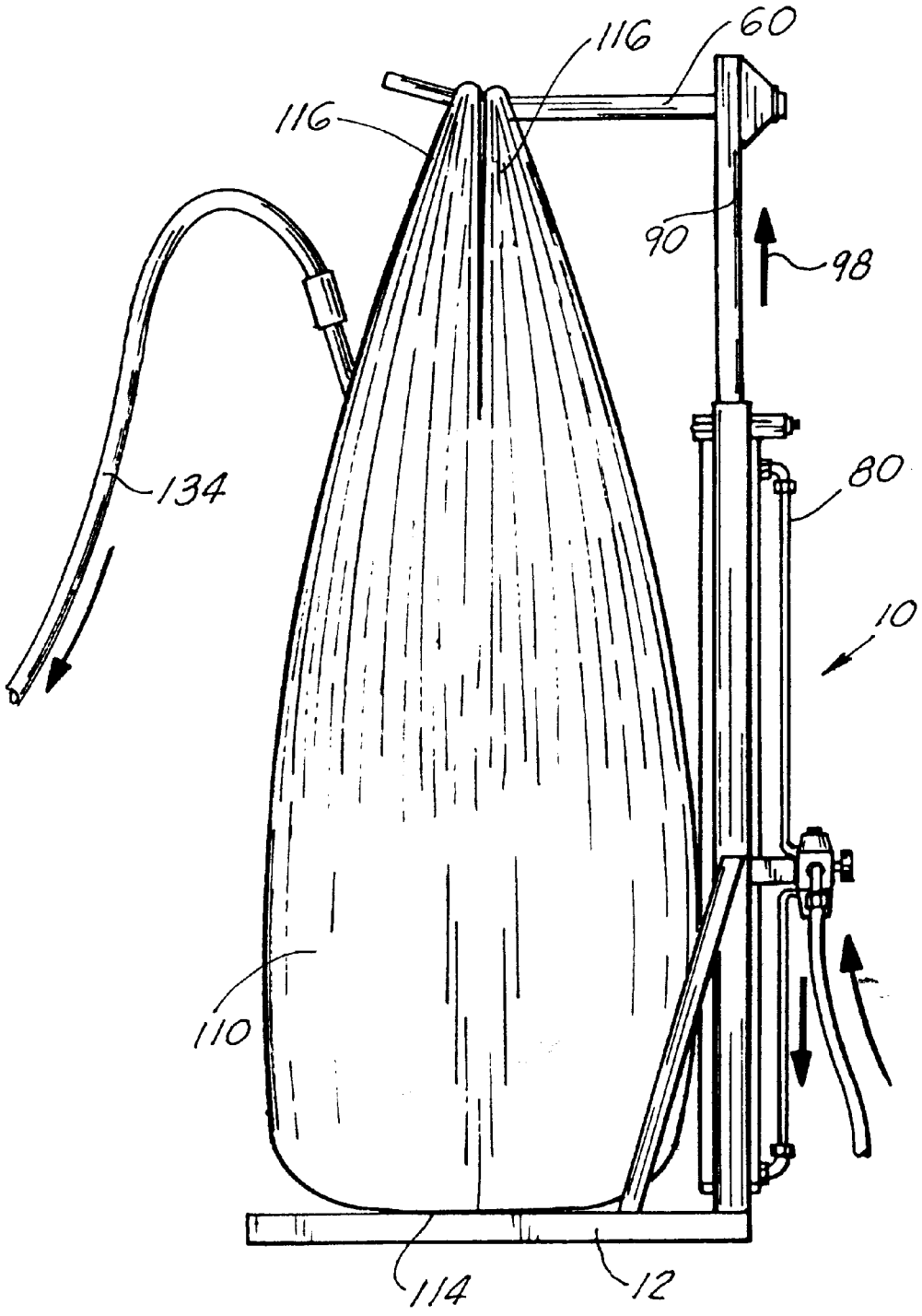
Figure 7:
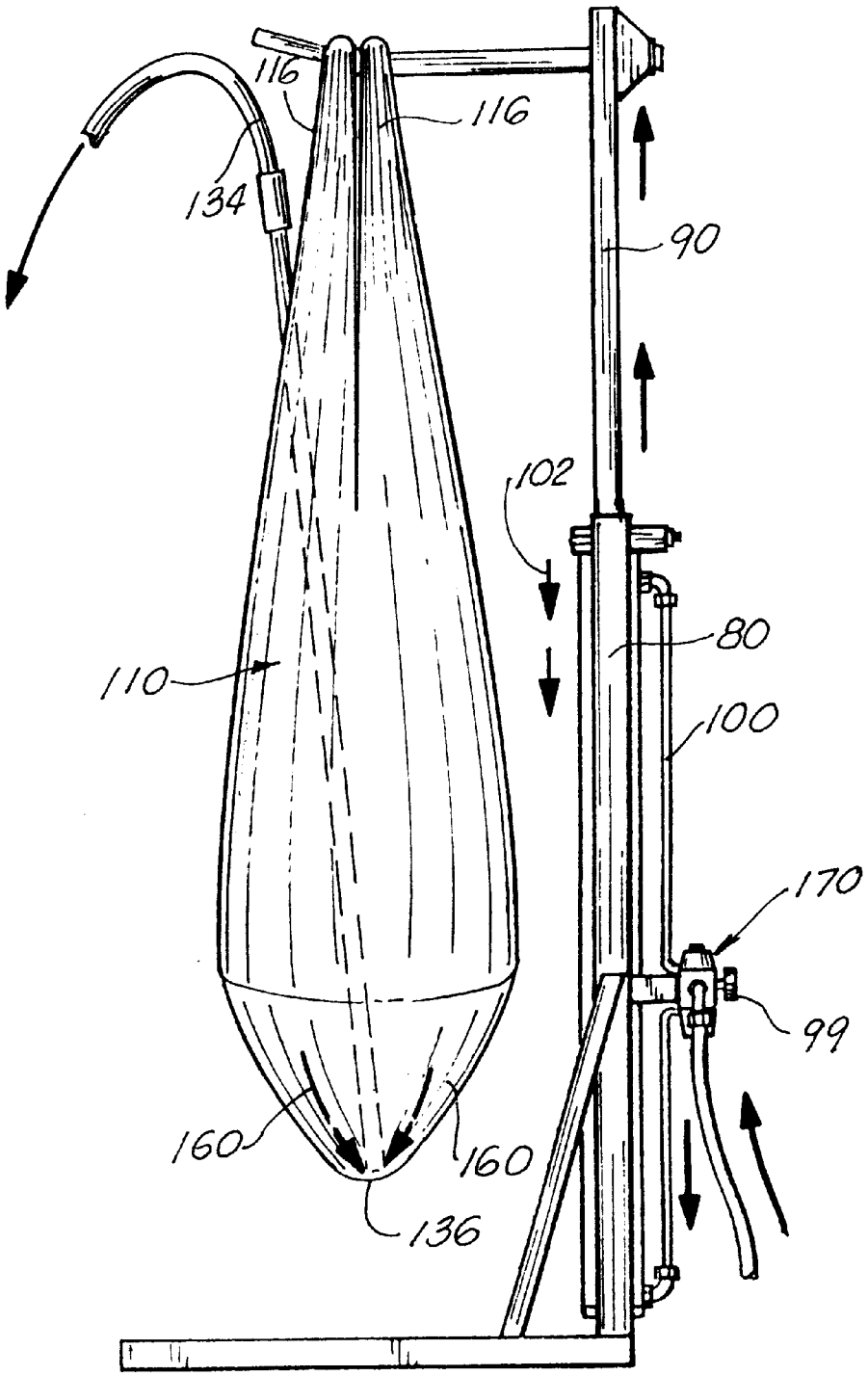

FIG. 6 illustrates an additional side view of additional product being siphoned from the bulk bag while the bulk bag is supported on the support frame; and FIG. 7 illustrates a side view of the bulk bag hanging from the support frame after sufficient product has been siphoned from the bulk bag in order to overcome the weight of the bulk bag and for the frame to be fully extended when the bag is finally emptied.

DETAILED DESCRIPTION OF THE INVENTION

Figure 1:
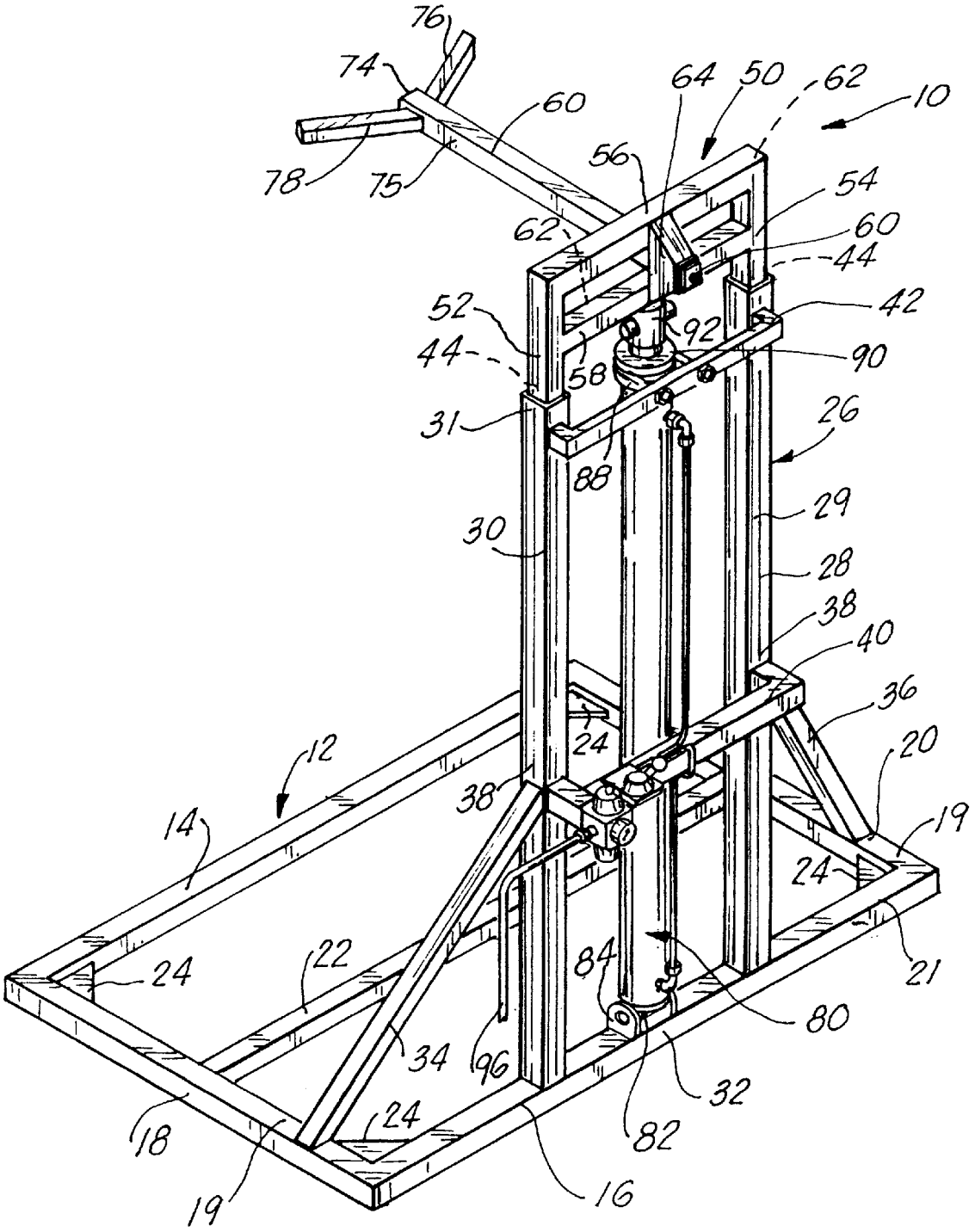
FIG. 1 illustrates an overall view of the system utilized for carrying out the method of the present invention.

FIGS. 1–7 illustrate the preferred embodiment of the components of the system of the present invention which are utilized to undertake the method of the present invention. Turning now to the components as illustrated, FIG. 1 illustrates an overall view of the support frame 10 that is utilized in the present invention. As illustrated in overall view, support frame 10 comprises a base portion 12, the base portion 12 formed in a generally rectangular configuration of metal bars which would generally include a front bar 14, a rear bar 16 and a pair of side bars 18, 20, the bars 14, 16, 18, 20 defining the rectangular frame 12, which would also include a transverse member 22 positioned between side bars 18, 20, to complete the frame 12 which would rest on the floor or a similar surface as illustrated in side views in FIGS. 2 and 3. Further as illustrated, there is include a plurality of corner support gussets 24, which provide additional stability to the rectangular frame 12 during its use. As further illustrated in the figures, rear bar 16 of base 12 would have supported thereupon an upright vertical frame 26. Upright vertical frame 26 would include a pair of parallel vertical frame members 28, 30, spaced apart from the center point 32 of bar 16. Each of the vertical members 28, 30, would be further supported upon bar 16 with a pair of angled support members 34, 36 which extend from substantially the midpoint 38 of each of the bar members 28, 30 to the upper face 19 of the side bar members 18, 20, and like all components, are welded thereto providing the necessary support to the vertical frame 26 for the reasons as will be discussed further. As further illustrated, there is further included support member 40 which connects members 28, 30 and extends substantially upon the midpoint of each of the vertical bars 28, 30, with support 40 extending along the rear part of the support members 28, 30, for supporting additional components, the function of which will be described further. Likewise, there is an additional upper transverse support 42 which, like support 40, extends and connects between each of the rear face 29 of each of the bars 28,30, and again is utilized for supporting additional components of the system as will be described further.

As seen particularly in FIG. 1, each of the upright vertical bars 28, 30 are formed of four metal plates 31, which are welded corner to corner so as to define a generally square passageway 44 there within. Housed within each of the passageways 44 formed by the walls 31 of each of the vertical members 28, 30, there is provided a slidable frame 50. The slidable frame 50 would comprise a first vertical leg 52, a second vertical leg 54, with an upper transverse member 56 connected therebetween and a lower transverse member 58 likewise connected between vertical legs 52, 54. It should be noted that in order to slidably accommodate the frame 50 within the square openings 44 of each of the legs 28,30, the general perimeter of each of the vertical members 52, 54 is slightly smaller than the interior perimeter of each of the openings 44, so as to allow slidability in the direction of arrow 55 as seen in FIGS. 2 and 3.

As further illustrated in the Figures, there is positioned intermediate transverse bars 56, 58 on frame 50 and a support member 60, the support member slidably engaged in the opening 62 between members 56, 58, and welded thereto via a rear mounting well plate 64 as illustrated in FIG. 1. The mounting plate 64 is secured to transverse members 56, 58, through welding, but includes a rectangular opening 62 therethrough, so that the upper extension member 60 is able to slide in the direction of arrow 68 as seen in FIG. 3, the function of which will be described further. The proximal end 70 of the member 60 has an enlarged portion 72 so that when it engages the rear face of the welding plate 64, as seen in FIG. 2, it is unable to slide any further in the direction of arrows 73, so that the distal end 74 is at its outermost point. The support member 60 would also include at its distal ends 74 a pair of angular support arms 76, 78, each of which are extending outward from the side wall 75 of the support member 60 at an angle approximately 120 degrees from the plane of side 75, so as to form the configuration from the distal end 74 as seen in the Figures.

Figure 3:
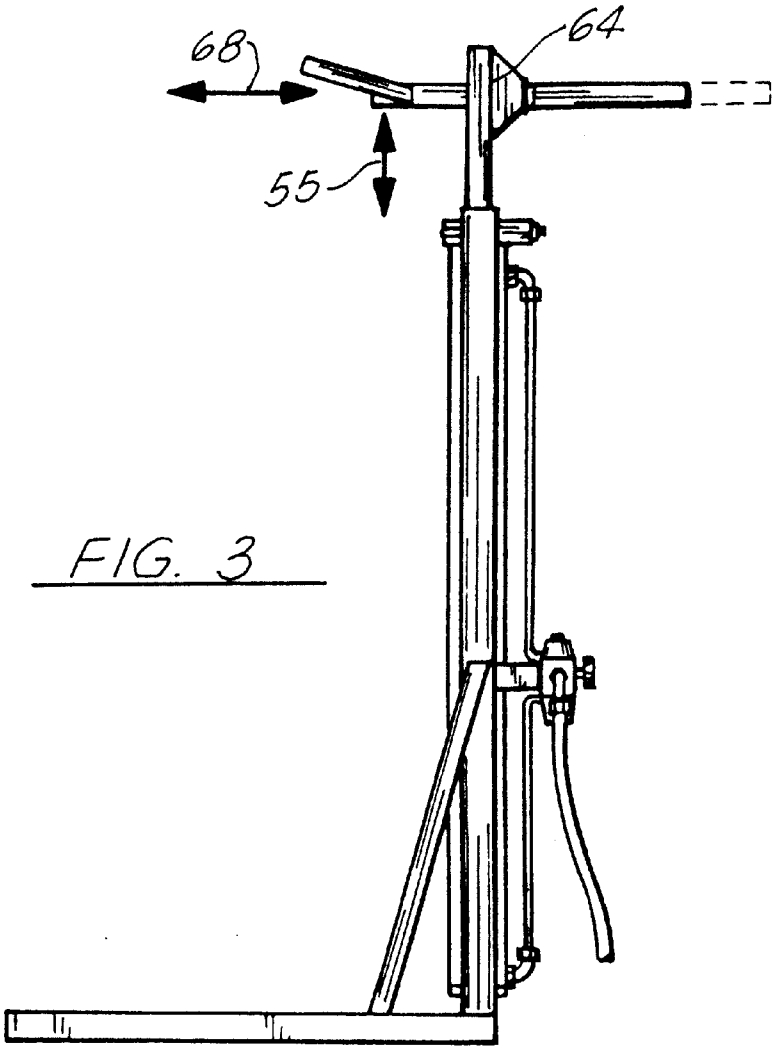
FIGS. 2 and 3 illustrate side views thereof.
Figure 2:
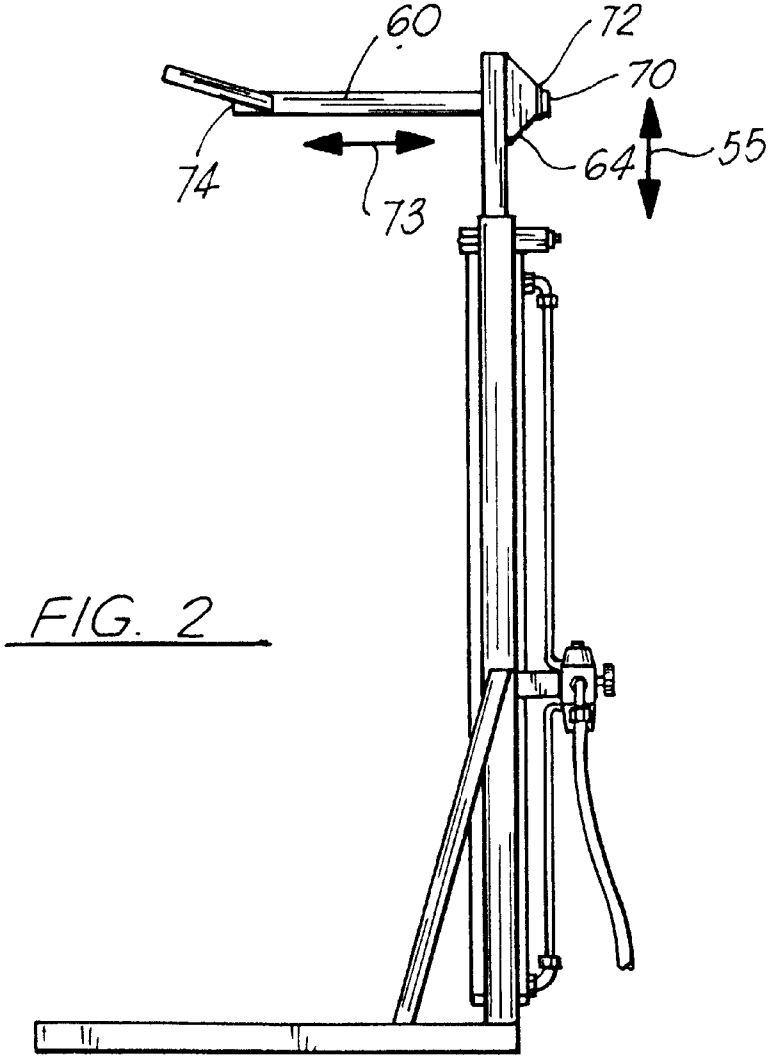
Figure 5:
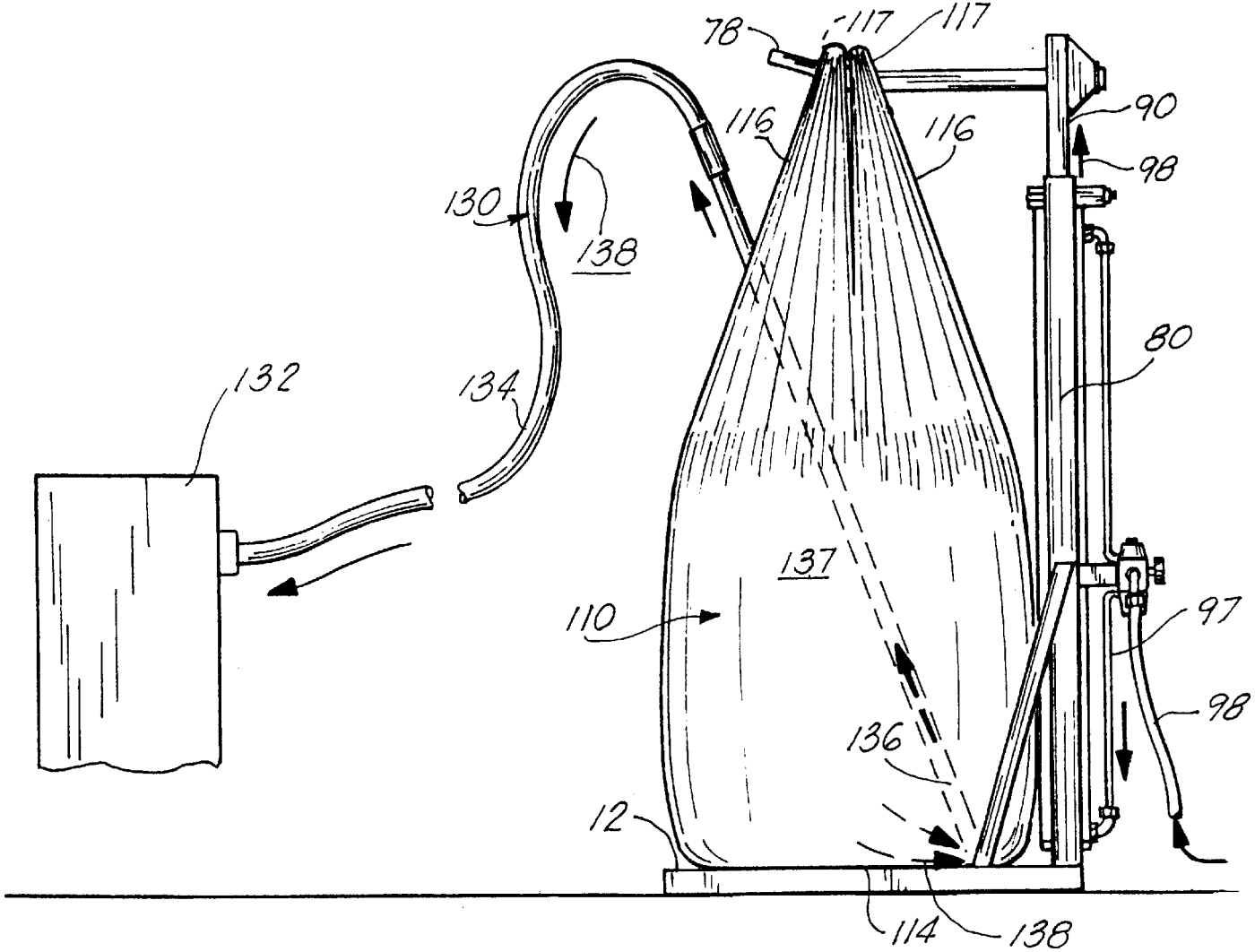
FIG. 5 illustrates a view of the bulk bag supported by the support frame of the present invention while a siphoning nozzle is siphoning product therefrom.

Turning now to additional structure of the support frame 10, reference is made to FIGS. 1–3 where there is illustrated a centrally located cylinder 80, the cylinder 80 mounted on its lower end 82 to the upper face 21 of rear bar 16, via a mounting bracket 84. The cylinder housing would extend upward and would be supported midway along the transverse bar 40 and would be further supported on its upper end 88 to the transverse bar 42 of the frame. Cylinder means 80 would be a pressurized cylinder of the type that would be operated via hydraulic fluid or pneumatic operation, with the cylinder 80 housing a piston 90 therein, with the piston 90 secured at its upper end 92 to the upper frame 50. Hydraulic or pneumatic fluid would be introduced into the system through principal fluid line 96. In order to move piston 90 in the direction of arrow 98 as seen in FIG. 5, fluid would be routed through fluid line 97 which would then push piston 90 upward to its highest point as seen in FIG. 7. Likewise, when one would wish to have the piston 90 travel down, fluid would be routed through line 100, as seen in FIG. 7, and the fluid would then allow piston 90 to move downward in the direction of arrows 102 so that it returns to its lowermost position. The flow of the fluid through either line 97 or 100 would be controlled by knobs 99 into which line 96 would route with knobs 99 directing the flow of the fluid into the upper portion or lower portion of the cylinder as the case may be. The reason behind this function of the piston will be described when the following discussion is made of the method of the present invention.

Figure 4:
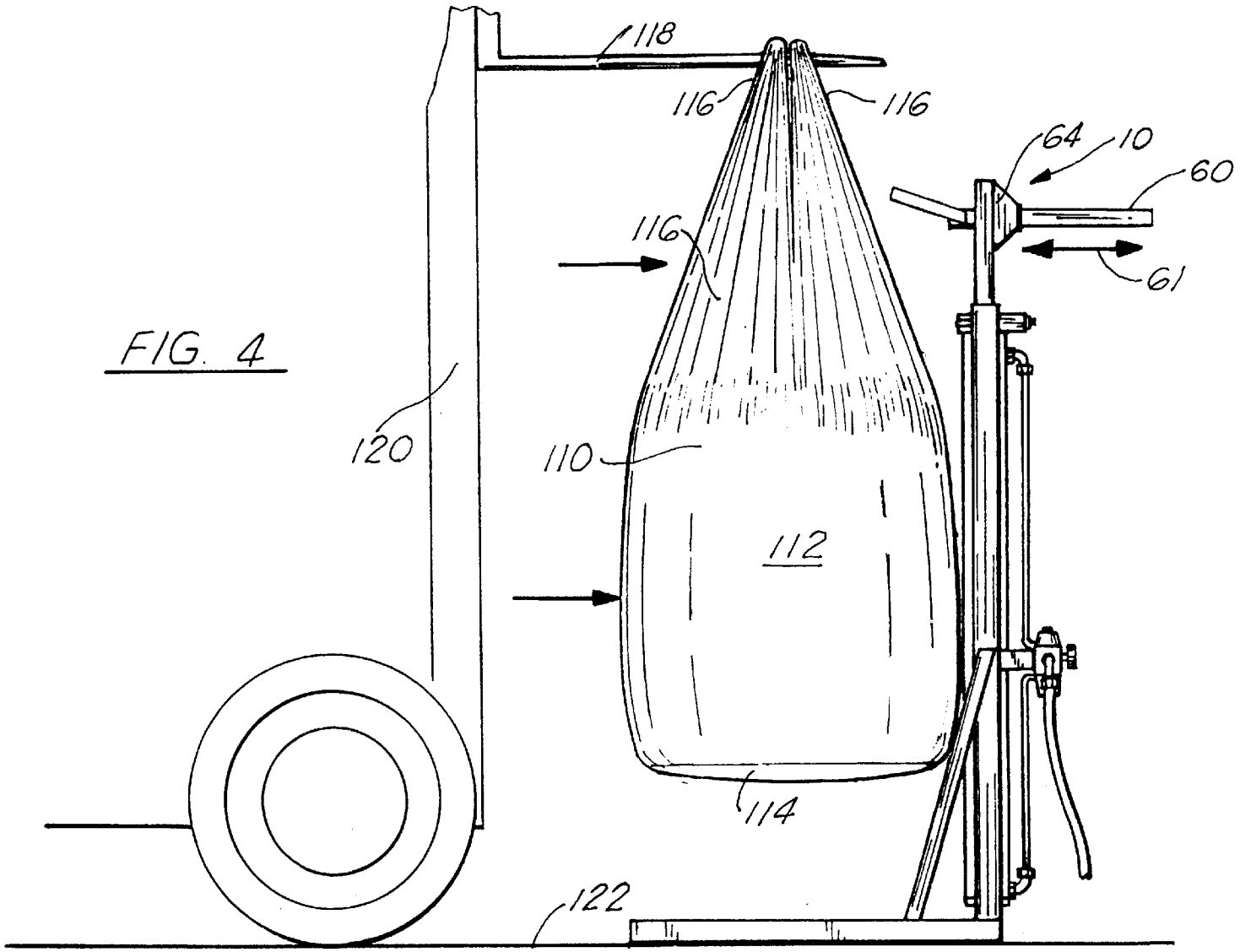
FIG. 4 illustrates a partial view of a filled bulk bag being placed onto the support frame of the present invention.

Having discussed the several components that are utilized in the system of the present invention, reference is made to FIG. 4, where there is illustrated the apparatus 10 ready to receive a bulk bag 110 which would generally comprise a continuous side wall 112, a closed floor portion 114 with the continuous wall portion 12 forming at its upper most end a pair of lifting arms or loops 116, formed by a continuation of the fabric of wall 112 and defining an opening 116 through which tines 118 of a forklift 120 would slip therethrough for lifting the bulk bag off of the floor 122 for positioning it on the apparatus 10. As seen in FIG. 4, the filled bulk bag, of the type that would be utilized normally with an interior liner of polyethylene, would be sealed off from the exterior since it would be filled with a dry bulk material, and would normally weigh in the neighborhood of two to three thousand pounds. At this point in the process, the bulk bag 110 is being positioned by forklift 120 onto apparatus 10, so that the bulk bag may be emptied of its contents undertaking the method of the present invention.

Turning now to FIG. 5, bulk bag 110 has been positioned via tines 118 so that the openings 117 in the lifting loops 116 are accommodated by the pair of arms 76, 78, of arm member 60, as was described more fully in FIG. 1. This is easily accomplished because support arm 60 is able to slide rearward in the direction of arrow 61, as seen in FIG. 4. Therefore, as seen in FIG. 4, when the forklift has lifted the bulk bag by its lifting loops 116, the support arm 60 would normally be retracted as seen in FIG. 4, so that the arm 60 is no longer over frame 12, and the forklift can move the bag substantially adjacent the upright frame as seen in the Figure. After the forklift has placed the bag in that position, the extender arm 60 is then returned to its extended length as seen in FIG. 5, where the arms 76, 78 will engage through the lifting loops so that the forklift may back away from the frame and the arm members 60 would support the bag by its lifting loops being engaged by arms 76, 78. At this point, the base 114 of the bulk bag is resting on the upper face of the base portion 12 of apparatus 10, with the lifting loops 116 extended upward held in place by arm 76, 78, with the bulk bag being maintained upright.

An important feature to the present invention as was noted earlier in the description of the system, was the hydraulic cylinder 80 which is utilized in the system. Retuning to FIG. 5, with the arm members 76, 78 engaged within the openings 117 of the lifting loops 116, hydraulic fluid would be introduced into line 96, and would be forcing the piston 90 in the direction of arrow 98 as illustrated in FIG. 5, putting upward force on the bag via lifting loops 116 as illustrated. However, for the present invention, because of the enormous weight of the bag at two to three thousand pounds, it is foreseen that the amount of upward pressure that the hydraulic or pneumatic cylinder 80 would impact upon the bag will be approximately one hundred pounds of upward force, which would be insufficient for lifting the bulk bag off of the base, but would be sufficient for maintaining the lifting loops in the up position and maintaining the bag held in place by the lifting loops, as the emptying of the bag took place.

At this point, there would be introduced a siphoning means 130 which would comprise a siphoning pump 132, a siphon hose 134, terminating in a siphoning nozzle 136. As illustrated in FIG. 5, nozzle 136 has been introduced into the internal space 137 of bag 110 by poking a hole through the polyethylene liner in the bag and sliding the nozzle through the bulk material contained in space 137 so that the end of the nozzle is substantially at the base 114 of the bag. At this point in time, the siphoning pump 132 would then begin siphoning material from the bag which would move in the direction of arrows 138 into the siphoning hose and would be collected in a collection bin as the case may be.

As this process is ongoing, reference is made to FIG. 6, whereas one would recall, the pressurized piston 90 has continued to put an upward force in the direction of arrow 98 through the use of the fluid within the cylinder, however maintaining a constant and maximum force of approximately one hundred pounds. FIG. 6 represents an additional phase of the emptying of the contents of the bag where the siphoning holes 134 has continued to siphon material from the bag, but as the bag empties out, and the bulk is removed from the bag 110, the side walls of the bag begin to constrict slightly because of the continuous upward force by the piston 90. It is important to note that at all times, because of the upward force on the lifting loops 116 by the piston 90, as the bulk bag is being emptied, it is maintained in the upright position supported at its uppermost end by the support arms 60 yet still resting on its base 114 against the frame 12 of the apparatus 10. In effect, as the bag empties, this pressure lifts the bag, causing it to assume an inverted cone shape, forcing the product within to funnel into the center of the bag, along with the vacuum nozzle 136. Therefore, there is no chance of the bag falling over or spilling as the contents are being removed from the bag, and because of the weight of the bag as it continues to have bulk within it, the upward force of the piston 90 does not lift the bag off of the base but yet maintains it upright as seen in the Figure.

Turning now to FIG. 7, this represents point at which most, if not all, of the product has been siphoned from the bag 110 by the siphon hose 134. At this point, as is illustrated, all of the bulk material within the bag has fallen in the direction of arrow 160 to the lowermost point of the bag, where the siphon nozzle 136 is located so the very last part of the bulk within the bag is siphoned therefrom. As the weight of the bulk creates less downward force than the upward force created by the piston 90, the piston 90 is able to be forced upward completely in its utmost position as seen in FIG. 7 literally lifting the bag 110 off of its base 114 and simply hanging from the lifting loops 116 as an empty bag. What has been accomplished therefore, is the fact that the bag as was stated earlier, has been maintained upright throughout the entire emptying process and could never fall over because of it being supported by the lifting loops yet at the same time because of the fact that the side walls of the bag are being constricted as upward force is maintained on the bag as product is emptied, the product in the bag would therefore continue to move towards the center part of the bag where the siphon nozzle 136 is located. Therefore, in addition to the bag not falling over because of its being supported by the lifting loops 116 on frame 60, the product within the bag is always being forced towards the center part of the bag by the constriction of the side walls as the bag is being emptied, and therefore, the nozzle 136 tends to hit very few, if any, void spots in the bag and siphons out all of the product from the bag as the process goes through its steps, as illustrated in FIGS. 5, 6 and 7.

Of course, following the siphoning of all of the product from the bag, the siphon hose 134 is removed from the bag, and the hydraulic or pneumatic fluid within the cylinder 80 is then routed via the operator knobs 99 to the upper flow line 100 which then would have the piston 90 return to its lowermost point in the direction of arrows 102 as it was in position in FIG. 4. At this point in the operation, as seen in FIG. 7, with the bag completely empty and the piston 90 retracted to its lowermost level, the empty bag would simply be manually removed from arms 76, 78, and following the removal of the empty bag therefrom, arm 60 would then be retracted into the position as seen in FIG. 3, so that the forklift may then move another filled bulk bag into position onto platform 12, and arm 60 could then be extended outward to the position as seen in FIG. 2 engaging the lifting loops of the bag sitting on base 12 and the process to be once more resumed.

The following table lists the part numbers and part descriptions as used herein and in the drawings attached hereto.

PARTS LIST

The following tables lists the part numbers and part descriptions as used herein and in the drawings attached hereto.

PARTS LISTS

| Description | Part No. |
|---|---|
| support frame | 10 |
| base portion | 12 |
| front bar | 14 |
| rear bar | 16 |
| side bars | 18, 20 |
| upper face | 19 |
| transverse member | 22 |
| support gussets | 24 |
| vertical frame | 26 |
| rear face | 29 |
| vertical frame members | 28, 30 |
| metal plates | 31 |
| center point | 32 |
| angles support members | 34, 36 |
| midpoint | 38 |
| support member | 40 |
| upper transverse support | 42 |
| square passageway | 44 |
| slidable frame | 50 |
| vertical leg | 52 |
| second vertical leg | 54 |
| arrow | 55 |
| transverse bars | 56, 58 |
| support member | 60 |
| opening | 62 |
| rear mounting well plate | 64 |
| arrow | 68 |
| end | 70 |
| enlarged portion | 72 |
| arrows | 73 |
| distal end | 74 |
| wall | 75 |
| support arms | 76, 78 |
| cylinder | 80 |
| lower end | 82 |
| mounting bracket | 84 |
| upper end | 88 |
| piston | 90 |
| upper end | 92 |
| lines | 96, 97 |
| arrow | 98 |
| operator knobs | 99 |
| line | 100 |
| arrows | 102 |
| bulk bag | 110 |
| continuous side wall | 112 |

-continued

The following tables lists the part numbers and part descriptions as used herein and in the drawings attached hereto.

PARTS LISTS

| Description | Part No. |
|---|---|
| closed floor portion | 114 |
| lifting loops | 116 |
| opening | 117 |
| tines | 118 |
| forklift | 120 |
| floor | 122 |
| siphoning means | 130 |
| siphoning pump | 132 |
| siphon hose | 134 |
| siphoning nozzle | 136 |
| internal space | 137 |
| arrows | 138 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for siphoning product from a bulk bag, and maintaining the bulk bag upright at all times during siphoning, comprising the following steps:

a. providing a bulk bag containing product;

b. providing a means for supporting the bag upright through the lifting loops of the bulk bag;

c. siphoning the product from the bulk bag; and d. imparting sufficient upward force on the lifting loops of the bulk bag by the supporting means to continue to hold the bag upright as the product is siphoned therefrom, and allowing the product remaining in the bag to move to the central portion of the bag.

2. The method in claim 1, further comprising the step of engaging lifting loops of the bulk bag onto a support arm of the supporting means so that the bag is held upright at all times.

3. The method in claim 1, wherein the means for supporting the bulk bag further comprises a support frame so that the bulk bag rests on a base of the frame while the lifting loops are engaged by the support bar.

4. The method in claim 1, wherein the supporting means further comprises a pressurized cylinder which places constant upward force on the lifting loops of the bag, sufficient to maintain the bag pulled upright during siphoning, yet imparting insufficient upward force to lift the bag filled with bulk.

5. The method in claim 1, wherein the step of siphoning is accomplished by inserting the end of a siphoning hose in product contained in the bag so that the product 15 siphoned through the hose out of the bag.

6. The method in claim 1, further comprising the step of placing sufficient upward force on the bag so that when the bag is substantially empty, the bag will be pulled off of the base, hung by the lifting loops.

7. The method in claim 1, further comprising the step of positioning the nozzle of the siphoning hose near the central bottom point of the bag so as to siphon all the material from the bag, as the bag is emptied, and the constriction of the walls due to the upward pull, forced the product toward the center point of the bag.

8. A system for siphoning bulk material from a bulk bag, comprising:

a. an upright support frame, having a base portion and an upright support portion;

b. a portion of the frame moveable between down and up positions, and supporting the lifting loops of the bulk bag;

c. a siphoning hose inserted through a top portion of the bulk bag, into the bulk contained in the bulk bag for siphoning bulk therefrom while the bulk bag is supported;

d. a pressurized cylinder engaged between the upright support frame and the moveable frame, for imparting upward force on the moveable frame while a bulk bag is supported thereon, and for continually imparting said upward force on the bulk bag as bulk is removed until the bulk bag is empty of bulk.

9. The system in claim 8, further comprising a support arm extending outward from the moveable frame for engaging the lifting loops of the bulk bag for supporting the bulk bag.

10. The system in claim 8, wherein the upward force imparted on the moveable frame is sufficient to maintain the bag supported upright, as more and more bulk is removed therefrom.

11. The system in claim 8, wherein the bulk bag space, as bulk is removed therefrom, becomes constricted so as to allow the siphoning hose to siphon bulk therefrom.

12. A method of siphoning bulk from a bulk bag containing dry bulk, of the type having sidewalls, a floor and lifting loops, the method comprising the steps of:

a. supporting the bulk bag upright by the lifting loops;

b. positioning a siphoning nozzle through a top of the bulk bag, into bulk material in the bag;

c. siphoning bulk from the bulk bag while it is supported; and d. imparting upward force on the lifting loops of the bulk bag sufficient to maintain the bulk bag upright until most of the bulk has been siphoned from the bag, while forcing the bulk remaining in the bulk bag to move to the center of the bag so that all of the bulk is siphoned from the bag.

13. The method in claim 12, wherein the siphoning nozzle is placed into the center of the bag so that as the bulk material is forced to the center of the bag, the nozzle siphons all of the bulk material from the bag.

14. The method in claim 12, wherein the step of supporting the bulk bag upright further comprises a frame for engaging the bulk bag at the lifting loops, and resting the bulk bag on a base of the frame.

15. The method in claim 12, wherein the step of siphoning the bulk from the bag comprises a siphoning hose inserted into the bulk within the bag and applying a vacuum thereto.

16. The method in claim 12, wherein the step of imparting sufficient upward force on the bag further comprises a pressurized cylinder positioned between the base of the frame and the support frame which imparts sufficient hydraulic or pneumatic pressure on the support frame for keeping the bulk bag extended upward until it has been completed emptied of bulk.

* * * * *